United States Patent [19]

Raetzsch et al.

[11] 3,990,961

[45] Nov. 9, 1976

[54] ANNULAR BRINE HEAD EQUALIZER

[75] Inventors: Carl W. Raetzsch; Hugh Cunningham, both of Corpus Christi, Tex.

[73] Assignee: PPG Industries, Inc., Pittsburgh, Pa.

[22] Filed: Nov. 28, 1975

[21] Appl. No.: 636,020

[52] U.S. Cl. ..... 204/255; 204/256

[51] Int. Cl.[2] ..... B01K 3/00

[58] Field of Search ..... 204/254, 255, 256, 257, 204/269, 275

[56] References Cited

UNITED STATES PATENTS

| | | | |
|---|---|---|---|
| 3,236,760 | 2/1966 | Messner | 204/256 |
| 3,755,108 | 8/1973 | Raetzsch et al. | 204/256 |
| 3,852,179 | 12/1974 | Raetzsch et al. | 204/255 |

*Primary Examiner*—T. M. Tufariello
*Attorney, Agent, or Firm*—Richard M. Goldman

[57] ABSTRACT

Disclosed is a bipolar electrolyzer having an anolyte equalizer between adjacent electrolytic cells. The electrolyte equalizer includes a conduit which passes through the cathode of one cell and through the catholyte chamber of that cell to a first aperture in the peripheral wall around the electrolyzer. The equalizer also includes a second aperture which passes through the electrolyzer peripheral wall to the anolyte chamber of the next adjacent cell in the electrolyzer. Finally, a channel carrier having an outer wall with a bearing surface and an inner wall with a bearing surface, the inner and outer walls forming a channel communicating with each of the apertures, and the bearing surfaces bearing against the peripheral wall, provides the equalizing channel between the adjacent cell.

5 Claims, Drawing Figures

ANNULAR BRINE HEAD EQUALIZER

DESCRIPTION OF THE INVENTION

Bipolar electrolyzers offer significant economies of construction and operation. Bipolar electrolyzers are characterized by a backplate, also known as a bipolar unit or a bipolar electrode. The backplate serves as a common structural member supporting the cathodes of one cell of a bipolar electrolyzer and the anodes of the next adjacent cell of the bipolar electrolyzer. The backplate further serves as a conductor of electrical current from the cathode of one cell to the electrolyzer through the backplate, to the anodes of the next adjacent cell in the electrolyzer. The backplate is electrolyte impermeable so as to prevent mixing of the catholyte liquor of one cell and the anolyte liquor of the next adjacent cell of the electrolyzer.

An individual electrolytic cell is formed by the anodes of one bipolar unit and the cathodes of the next adjacent bipolar unit. The cathodes are electrolyte permeable structures formed of electrolyte impermeable metal and covered with a permeable barrier such as a diaphragm, a permionic membrane, or an ion exchange membrane. The barrier divides the cell into a catholyte chamber containing the cathodes and an anolyte chamber containing the anodes. Additionally, there may be a plurality of diaphragms in a single cell dividing the cell into an anolyte chamber, a catholyte chamber, and one or more intermediate chambers between the anolyte chamber and the catholyte chamber.

In the operation of a bipolar electrolyzer, brine is fed into each of the separate cells in the electrolyzer and an electrical potential is imposed across the entire electrolyzer. The electrical potential causes current to flow from a power supply to an anodic end unit of the electrolyzer and from the anodic end unit of the electrolyzer through the individual cells, in series, to a cathodic end unit of the electrolyzer, and then back to the power supply or to an adjacent bipolar electrolyzer in the cell plant.

The brine feed to the cell is a brine which may be saturated either at ambient temperature or at an elevated temperature, or unsaturated. When the brine is sodium chloride it typically contains about 300 to about 325 grams per liter sodium chloride. Chlorine is recovered from individual anolyte chambers of the electrolyzer while hydrogen gas and cell liquor are recovered from individual catholyte chambers of the electrolyzer. When the permeable barrier is an asbestos diaphragm, the cell liquor contains approximately from about 120 to about 225 grams per liter of sodium chloride and from about 110 to about 150 grams per liter of sodium hydroxide.

Where a permionic membrane is used rather than an asbestos diaphragm, or where there are a plurality of permionic membranes or diaphragms between the anolyte chamber and the catholyte chamber, the catholyte cell liquor may contain up to 300 or more grams per liter of sodium hydroxide and considerably lesser amounts, e.g., less than about 80 grams per liter of sodium chloride and most frequently less than about 10 grams per liter of sodium chloride.

It has been found that if the temperature of the brine in the brine feed to the cells should drop, or if the salt content in the brine feed should increase, some deposition of salt crystals in the brine feed lines will occur. This will most frequently occur at orifices, bends, joints, and discontinuities in the brine feed line. When such a blockage occurs in the brine feed the flow of brine to an individual cell in the electrolyzer is interrupted causing the anolyte level to drop. This may result in anomalies in the operation of an individual cell. For example, the cathodes may become exposed to chlorine gas, hydrogen may enter the anolyte compartment through the diaphragm, the anolyte may boil, and arcing may even occur across the electrodes resulting in a burned out cell.

If these anomalies occur, it is likely that catastrophic failure of the electrolyzer could follow. Accordingly, it is necessary to provide equalizer means in a bipolar electrolyzer. The equalizer means maintain a uniform head of anolyte in the individual cells by providing hydraulic communication therebetween.

In bipolar electrolytic cells of the prior art, such as disclosed in U.S. Pat. No. 3,337,443 to Carl W. Raetzsch et al. and U.S. Pat. No. 2,282,058 to R. M. Hunter et al., maintenance of substantially equal anolyte heads in each of the individual cells was provided by seepage around the backplate between individual cells, or by openings in the backplate below the cathodes. In still other bipolar diaphragm cells, for example, U.S. Pat. No. 3,236,760 to G. Messner for a bipolar hydrochloric acid cell, equalizing is provided in combination with the anolyte feed means. That is, anolyte is fed to the individual cells through a manifold or header which is below the level of electrolyte in the anolyte chamber. In this way, the feed manifold or header also serves as the equalizer. Such an arrangement is satisfactory in an electrolytic cell where the electrolyte feed is unsaturated and at a temperature and concentration far from conditions of potential saturation and crystallization. However, the combination of a single electrolyte feed and anolyte equalizing means is not feasible in a chlor-alkali cell where the feed is saturated brine.

U.S. Pat. No. 3,755,108 to Carl W. Raetzsch et al. shows an external equalizing system. Such an external equalizing system as there disclosed while satisfactory from an operational point of view calls for more equalizing hardware than is called for in the design herein contemplated.

U.S. Pat. No. 3,852,179 to Carl W. Raetzsch et al. provides an internal equalizing means which, while satisfactory, requires additional fabrication steps in the assembly of backplate than the design herein contemplated.

It has now been found that a rugged, easily assemblable equalizer for bipolar diaphragm cells may be provided by a simple annular channel in a readily removable, external, circular channel carrier, connecting an aperture leading into the anolyte chamber of one cell with an aperture which leads from the anolyte chamber of an adjacent cell through the catholyte chamber to corresponding aperture in a peripheral wall of the electrolyzer.

THE FIGURES

The apparatus of this invention may be understood by reference to the accompanying figures.

DETAILED DESCRIPTION OF THE INVENTION

Figure 1:
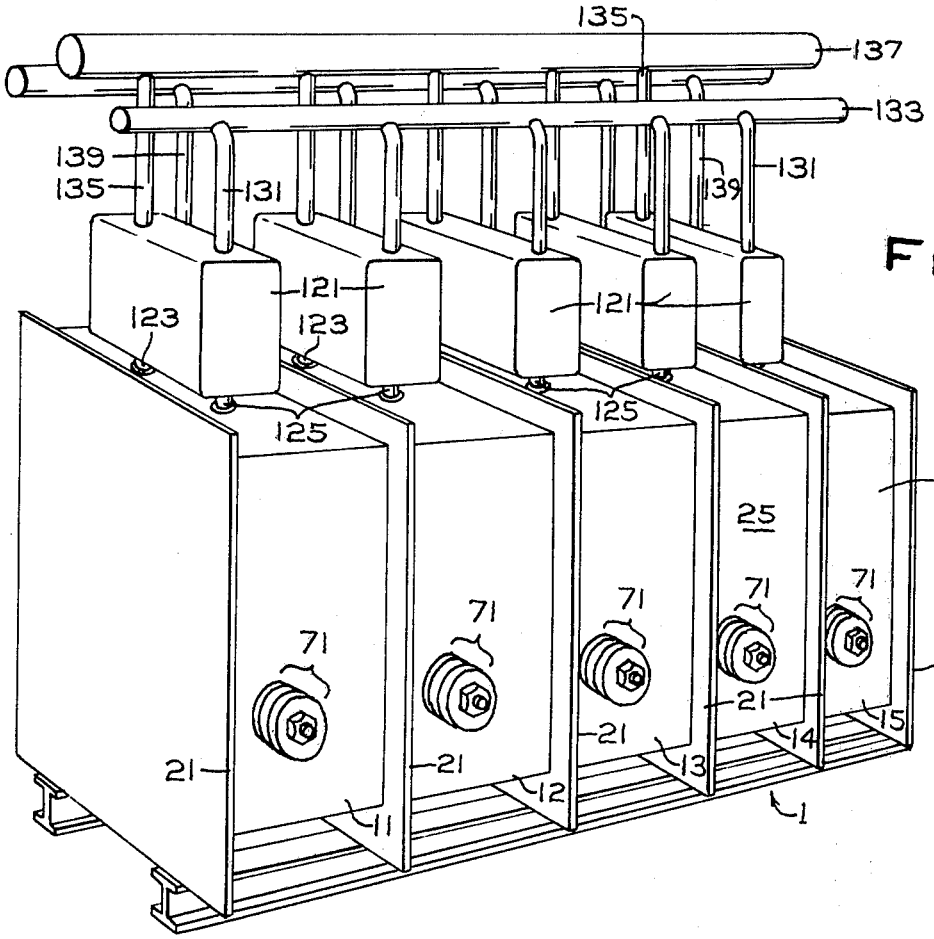
FIG. 1 shows a perspective view of a bipolar electrolyzer of this invention.

A typical bipolar electrolyzer 1 is shown in FIG. 1. The bipolar electrolyzer has a plurality of individual cells 11, 12, 13, 14, and 15 electrically and mechanically in series. Each individual electrolytic cell 11, 12, 13, 14, 15 is formed by a pair of facing bipolar units 21 and the peripheral walls 25 of the electrolyzer. Brine boxes 121 are on top of the individual electrolytic cells. Pipes 123 and 125 connect the individual electrolytic cells to the brine boxes 121 carrying chlorine from the cells 11, 12, 13, 14, 15 to the brine boxes 121 and brine from the brine boxes 121 to the cells 11, 12, 13, 14, 15. The brine boxes 121 receive brine through brine lines 131 from brine header 133 and discharge chlorine through chlorine lines 135 to chlorine header 137. Hydrogen is recovered from the individual cells 11, 12, 13, 14, 15 through hydrogen lines 139 and collected in hydrogen header 141.

Figure 2:
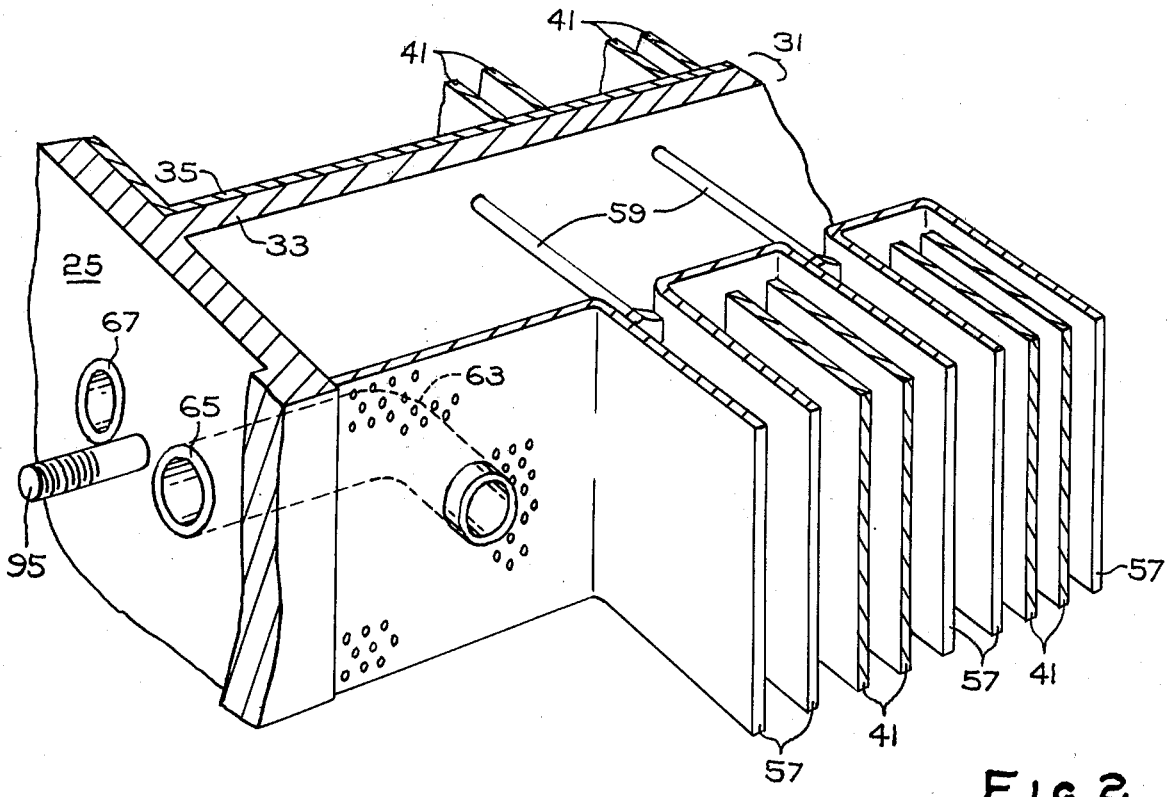
FIG. 2 shows a cutaway of a bipolar unit incorporating the equalizer of this invention.

An individual bipolar unit 21 is shown in partial cutaway in FIG. 2. The bipolar unit 21 includes a backplate 31 with anodes 41 extending from one side and cathodes 51 depending from the opposite side.

The backplate 31 has a bimetallic structure having a steel plate 33 and a titanium sheet 35 with the steel plate 33 facing the catholyte liquor of one cell in the electrolyzer and the titanium sheet 35 facing the anodic side of the next adjacent cell in the electrolyzer. Within the anolyte chamber, the peripheral walls 35 of the electrolyzer 1 are titanium, for example, titanium cladding, titanium sheet, or the like.

Spaced from and parallel to the cathodic surface 33 of the backplate 31 is a cathode back screen 53. The cathode back screen 53 and the cathodic surface 33 and the backplate 31 define a catholyte volume. Extending from and in hydraulic communication with the catholyte volume are hollow cathode fingers 55. The cathode fingers 55 may be in the form of perforate metal fingers or metal mesh fingers.

The cathode structure 51 includes a cathode back screen 53 with individual cathode fingers 55 having side walls 57 and enclosures at the top, bottom, and extreme end extending outwardly therefrom (not shown). Electrical conduction means, for example, studs 59, connect the cathodes 51 to the backplate 31 and may pass through the backplate 31 to the anodes 41 on the opposite surface of the backplate 31.

The cathode back screen 53 extends behind the individual cathode fingers 55 and extends from one peripheral wall 25 of the electrolyzer 1 to the opposite peripheral wall (not shown). The individual cathode fingers 55 and the cathode back screen 53 may be covered with a suitable permeable barrier when the cell is used for the production of hydrogen and chlorine. For example, the permeable barrier may be an asbestos diaphragm or permionic membrane or an ion exchange resin.

Figure 3:
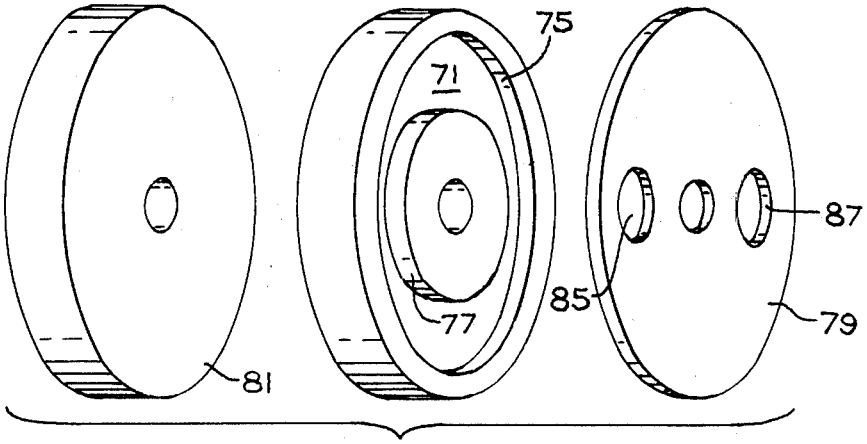
FIG. 3 shows one structure of the equalizer channel carrier of this invention.
Figure 4:
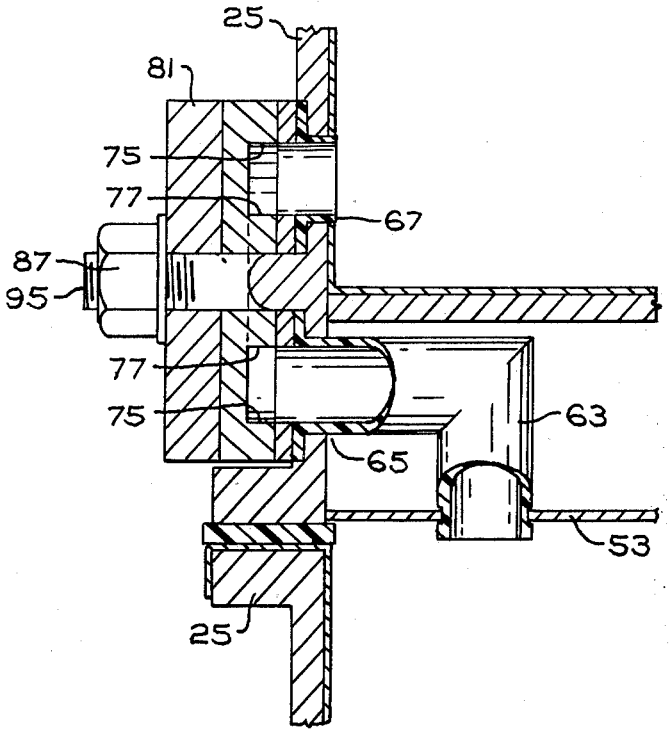
FIG. 4 shows a plane view through plane 4—4′ of FIG. 2.

In an assembled electrolyzer, the anodes 41 of one bipolar unit or bipolar electrode 21 are interleaved between the cathodes 51 of the next adjacent bipolar unit or bipolar electrode 21 forming a single diaphragm cell. A bipolar unit or bipolar electrode 21 including anode 41 and cathode 51 and an equalizer 71 is shown in FIG. 3. The bipolar unit 21 has interior walls in contact with the anolyte liquor and backplate 31 with an anodic surface 35 typically a plate or thin sheet, e.g., on the order of from about 0.08 inch or thinner of an anolyte resistant metal.

According to an alternative design, the anolyte resistant surface 35 of the backplate 31 as well as the anolyte resistant surface on the interior walls of the electrolyzer may be provided by neoprene or ethylenepropylenediene rubber or the like.

The anode fingers 41 extend outwardly from the anodic surface 35 of the backplate 31. Typically the anodes 41 are valve metal sheets, plates, or blades as described above. They may be perforated or foraminous or expanded mesh or even rods. The coatings are those which provide a low chlorine overvoltage, chlorine resistant surface. Typical coating materials are the platinum group metals, their oxides, their oxygen-containing compounds, and mixtures and solid solutions thereof of their oxides, oxides of titanium, zirconium, hafnium, tantalum, tungsten, and the like.

When the anodic surface 35 of the backplate 31 and the anolyte resistant walls of the electrolyzer 1 are provided by an anolyte resistant metal, the anolyte resistant metal is a valve metal, i.e., a metal which forms a protective oxide film upon exposure to acidic media under anodic conditions. The valve metals include titanium, hafnium, zirconium, tantalum, tungsten, columbium, and their alloys. Most commonly, titanium is used and when titanium is referred to herein with reference to the anolyte resistant surface of the backplate or to the equalizer means itself, it will be understood that all of the other valve metals are equally intended thereby.

Electrolyte transport between the anolyte chamber of one cell and the anolyte chamber of the next adjacent cell is facilitated by the equalizer means 11. The equalizer means are means responsive to differential heads of anolyte hydrostatic pressure in adjacent individual electrolytic cells for withdrawing anolyte liquor from one cell and passing it to an adjacent cell. The equalizer means, for example, include a conduit 63 through the cathode 51 and catholyte chamber of the prior cell to an aperture 65 in the peripheral wall 25 of the prior cell, a second aperture 67 through the peripheral wall 25 of the electrolyzer 1 into the anolyte chamber of the next adjacent individual electrolytic cell of the electrolyzer 1, and channel means 71 for carrying the anolyte liquor from the first aperture 65, externally of the electrolyzer 1, to the second aperture 67, i.e., the aperture 67, in communication with the anolyte chamber of the next adjacent electrolytic cell in the electrolyzer.

The first aperture 65 communicates with the anolyte chamber of the first electrolytic cell through conduit means 63. The conduit means 63 provides hydraulic communication between the anolyte chamber of the first electrolytic cell, through the cathode 53 and the catholyte chamber thereof to an aperture 65.

The conduit means 63 passing from the anolyte chamber of the first electrolytic cell to the cathode and catholyte chamber of the first cell to the first aperture 65, is typically fabricated of a material that is resistant to anolyte liquor on the interior and resistant to catholyte liquor on the exterior, for example, the conduit may be a single conduit fabricated of material that is resistant to both the anolyte liquor and the catholyte liquor, such as KYNAR (TM), TEFLON (TM), and similar fluorinated hydrocarbons. Metals resistant to both the anolyte liquor and the catholyte liquor may also be used. The interior diameter of the conduit 63 may be from about ¼ inch to about 2 inches.

The conduit terminates in the first aperture 65 in the peripheral wall 25 of the electrolyzer 1. The first aperture 65 communicates with a channel 71 within the channel carrier means 23. The channel transfers anolyte liquor between the anolyte chamber of one cell and the anolyte chamber of the next individual cell, through an annular passageway. The annular passageway is a channel 73 defined by an outer wall 75 and an inner wall 77 of the channel carrier means 71.

According to one exemplification of this invention, the channel carrier means 71 may be provided by an outer wall 75 which is a circumferential wall such as a raised portion of a plate or flange. According to this exemplification, the inner wall 77 is provided by a raised central portion of the plate or flange.

According to an alternative exemplification of this invention, the outer wall 75 may be provided by a ring-type structure in which case the inner wall 77 may be provided by a plate or flange or disc of lesser diameter than the interior diameter of the ring. The inner wall is integral with the outer wall and spaced inwardly therefrom thereby defining a channel or annular recess 73. For example, the channel 73 may be defined by the interior wall 75 of the ring, the outer wall 77 of a disc, a gasket 79 against a peripheral wall 25 of the electrolyzer 1, or the peripheral wall 25 of the electrolyzer 1 itself as one surface and a gasket or flange 81 as the opposite surface. Alternatively, the channel 71 may be defined by inner 77 and outer 75 walls extending outwardly from plate or flange defining an annular recess within the plate or flange, the electrolyzer peripheral wall 25 or gasket 79 depending therefrom, and the flange itself.

Preferably, the peripheral wall 25 of the electrolyzer 1 has a suitable gasket 79 thereon to prevent contact between the side wall and the anolyte liquor.

According to this exemplification, a gasket 79 is compressed between the bearing surface of the channel carrier means 71 and the peripheral walls 25 of the electrolyzer 1 providing electrolyte tight seals between the peripheral walls of the electrolyzer and the gasket, and between the gasket and the bearing surfaces of the channel carrier means and having apertures 85, 87 corresponding to the apertures 65, 67 in the electrolyzer peripheral wall 25.

The electrolyte liquor may then pass between the channel and the aperture in the peripheral wall of the next adjacent cell, providing communication between the anolyte chamber of the next adjacent cell and the electrolyzer and the channel means.

The circular equalizer means is removably joined to the cell body as by bolt means 85 passing from the peripheral wall 25 of the electrolyzer 1 through an aperture corresponding to the bolt means 85 in the gasket 79 and in the central portion of the channel carrier means 71. The bolt means 85 terminates in a compressive means such as a nut 87 bearing on the exterior surface of the channel carrier means 71.

While various shapes are possible for the equalizer channel carrier means 73 it will most likely be circular in order to take advantage of the ease of installation and removal thereof and the ease of fabricating a circular equalizer channel carrier means, for example, by merely machining a recess from or casting a recess in a flange or plate.

The channel carrier means 71 is typically fabricated of a material that is resistant to attack by anolyte liquor under anodic conditions. For example, the channel carrier may be fabricated of a plastic material such as chlorinated polyvinylchloride. Alternatively, it may be fabricated of a valve metal as defined hereinabove such as titanium, tantalum, tungsten, hafnium, zirconium, and the like.

It is to be understood that although the invention has been described with specific reference to particular embodiments thereof, it is not to be so limited as changes and alterations therein may be made which are within the full intended scope of this invention as defined by the appended claims.

We claim:

1. In a bipolar electrolyzer having a plurality of bipolar units in series, each of said bipolar units having a peripheral wall, anodic means on one side thereof and cathodic means spaced from and electrically and mechanically connected to the opposite, cathodic side thereof and defining a catholyte chamber therebetween, the anodic side of one bipolar unit and the cathodic side of the next adjacent bipolar unit forming an electrolytic cell therebetween having a catholyte chamber and an anolyte chamber, the improvement wherein said bipolar electrolyzer has electrolyte equalizing means between adjacent electrolytic cells comprising;

a. conduit means passing through said cathode means and said catholyte chamber to a first aperture in said peripheral wall;

b. second aperture means passing through said peripheral wall to the anolyte chamber of the next adjacent cell;

c. channel carrier means having an outer wall with a bearing surface thereon, and an inner wall with a bearing surface thereon, said inner and outer walls forming a channel communicating with each of said apertures therebetween;

d. gasket means corresponding to the bearing surfaces of said inner and outer walls, and having apertures therein corresponding to said channel and to the apertures in the cell peripheral walls; and e. compressive means to provide a liquid tight seal between the cell peripheral wall and the gasket means and between the gasket means and the bearing surfaces of the channel carrier means.

2. The bipolar electrolyzer of claim 1 wherein said channel carrier means comprises plate means having a circumferential wall and a central raised portion with a recessed channel therebetween.

3. The bipolar electrolyzer of claim 1 wherein said channel carrier means comprises a ring as the outer wall thereof, a disc as the inner wall thereof, and a flange bearing upon second bearing surfaces of said ring and disc opposite the peripheral wall of said electrolyzer.

4. The bipolar electrolyzer of claim 3 wherein second gasket means are interposed between flange and said ring and disc.

5. The bipolar electrolyzer of claim 1 wherein said channel carrier means is removable.

* * * * *